United States Patent [19]

Haag et al.

[11] Patent Number: 4,727,735

[45] Date of Patent: Mar. 1, 1988

[54] ELECTROPNEUMATIC POWER DOOR LOCK CONTROL FOR MOTOR VEHICLE

[75] Inventors: Ronald H. Haag, East Detroit; Lloyd W. Rogers, Utica, both of Mich.

[73] Assignee: General Motors Corporation, Detroit, Mich.

[21] Appl. No.: 938,991

[22] Filed: Dec. 8, 1986

[51] Int. Cl.[4] ..... E05B 53/00

[52] U.S. Cl. ..... 70/264; 70/267; 70/277

[58] Field of Search ..... 70/264, 262, 263, 266–269, 70/275, 277; 292/DIG. 3, DIG. 4

[56] References Cited

U.S. PATENT DOCUMENTS

| | | | |
|---|---|---|---|
| 2,888,287 | 5/1959 | Taylor | 292/33 |
| 3,084,757 | 4/1963 | Oishei et al. | 70/264 X |
| 3,096,112 | 11/1961 | Johnstone | 292/3 |
| 3,111,184 | 3/1960 | Oishei | 180/82 |
| 3,653,237 | 4/1972 | DuRocher | 70/264 |
| 4,181,191 | 1/1980 | Hoffmann et al. | 180/289 |
| 4,253,319 | 3/1981 | Feichtiger et al. | 70/264 |
| 4,466,263 | 8/1984 | Rathmann | 70/264 |
| 4,468,942 | 9/1984 | Grabner et al. | 70/264 |
| 4,519,227 | 5/1985 | Dumbser et al. | 292/DIG. 3 X |
| 4,676,082 | 6/1987 | Huber et al. | 70/264 |

FOREIGN PATENT DOCUMENTS

| | | | |
|---|---|---|---|
| 2805004 | 8/1979 | Fed. Rep. of Germany | 70/263 |
| 2942852 | 5/1981 | Fed. Rep. of Germany | 70/264 |
| 3140327 | 4/1983 | Fed. Rep. of Germany | 70/264 |
| 3248194 | 6/1984 | Fed. Rep. of Germany | 70/264 |
| 3400945 | 7/1985 | Fed. Rep. of Germany | 70/264 |

*Primary Examiner*—Robert L. Wolfe
*Assistant Examiner*—Suzanne L. Dino
*Attorney, Agent, or Firm*—Robert M. Sigler

[57] ABSTRACT

An electropneumatic door lock control in which a pump activatable to generate a first or second pressure is controlled by a bistable pressure latch and communicated through passenger lock and auxiliary solenoids to pneumatic passenger lock and auxiliary actuators. Initiation means for first and second locking operations of a passenger door lock and a third locking operation of an auxiliary lock are interconnected with the bistable pressure latch, a bistable passenger latch and a bistable auxiliary latch and first and second timers to control the locking operations so that the first and second locking operations generate different pressures but activate the same timer for a duration of activation while the third locking operation generates one of the pressures but activates the other timer for a different duration of activation. With each activation of one of the initiation means the non-chosen latches and timer are deactivated. The auxiliary actuator may be a vehicle trunk lid release or fuel filler door release.

2 Claims, 3 Drawing Figures

ELECTROPNEUMATIC POWER DOOR LOCK CONTROL FOR MOTOR VEHICLE

BACKGROUND OF THE INVENTION

This invention relates to power door lock apparatus for motor vehicle doors, and particularly to such apparatus which is electrically controlled and pneumatically powered. Such a system has potential advantages in quietness and weight over all electric systems, especially if a large number of door locking or releasing mechanisms are included.

A typical such system is required to lock and unlock, from a single switch, all passenger doors. In addition, such a system should be capable of separately unlocking or releasing auxiliary doors such as the trunk or deck lid and the fuel filler door. Such a system may use a single bidirectional electric motor driven pump which generates vacuum driven one way and positive pressure above atmosphere when driven in the opposite direction. The pressure or vacuum from the pump is admitted by solenoid valves to pneumatic lines connected to the various actuators. Such a system should coordinate the operation of the pump and solenoids to prevent the inadvertent operation of one type of mechanism when another conflicting operation is started but allow override of one type of operation by another when desired. For example, if an action involving vacuum is in progress, the system should prevent the generation of positive pressure in the lines unless this is required by a later initiated overriding operation, in which case the system must first stop the vacuum production. As another example, a driver wishing to unlock the doors for his passengers does not necessarily wish to release the fuel filler latch and have the fuel filler door spring open; but he may wish to do the latter at a different time without unlocking the passenger doors.

The prior art in electropneumatic door lock systems is generally of the type shown in U.S. Pat. No. 3,096,112 to Johnstone, issued July 2, 1963, in which all door lock or release actuators are pneumatically connected in common to the pump to be locked or unlocked together. Similar systems are shown in U.S. Pat. No. 4,468,942 to Grabner et al, issued Sept. 4, 1984, U.S. Pat. No. 4,253,319 to Feichtiger et al, issued Mar. 3, 1981, U.S. Pat. No. 4,466,263 to Rathmann, issued Aug. 21, 1984, U.S. Pat. No. 4,181,191 to Hoffmann et al, issued Jan. 1, 1980, and U.S. Pat. No. 3,111,184 to Oishei, issued Nov. 19, 1963. U.S. Pat. No. 2,888,287 to Taylor, issued May 26, 1959, shows a variation in that the pneumatic lines to the four passenger doors are each controllable by a manually operated valve to be left out of the common actuation. However, none of these examples of the prior art allows selective independent power activation of a passenger door and and auxiliary door such as a trunk lid or fuel filler door with circuitry preventing non-desired activations but allowing override of an earlier, unfinished operation by a later initiated conflicting operation.

SUMMARY OF THE INVENTION

The invention is an electropneumatic door lock control in which a pump activatable to generate a first or second pressure is controlled by a bistable pressure latch and communicated through passenger lock and auxiliary solenoids to pneumatic passenger lock and auxiliary actuators. Initiation means for first and second locking operations of a passenger door lock and a third locking operation of an auxiliary lock are interconnected with the bistable pressure latch, a bistable passenger latch and a bistable auxiliary latch and first and second timers to control the locking operations so that the first and second locking operations generate different pressures but activate the same timer for a duration of activation while the third locking operation generates one of the pressures but activates the other timer for a different duration of activation. With each activation of one of the initiation means the non-chosen latches and timer are deactivated. Further details and advantages of the invention will be apparent from the accompanying drawings and following description of a preferred embodiment.

DESCRIPTION OF THE PREFERRED EMBODIMENT

Figure 1:
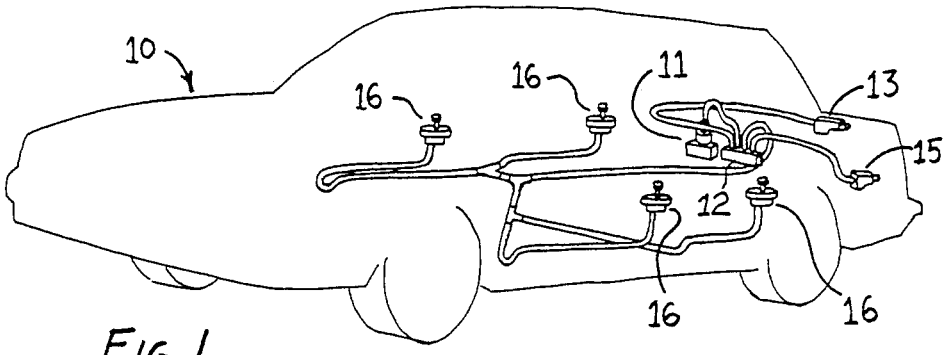
FIG. 1 is a schematic view of a motor vehicle with an electropneumatic actuation system according to the invention.

FIG. 1 shows the outline of a motor vehicle 10 showing a vacuum/pressure pump 11, solenoid valve assembly 12, deck lid release actuator 13, fuel filler door release actuator 15 and door lock actuators 16. The actuators 13, 15 and 16 and the vacuum/pressure pump 11 are connected pneumatically with the solenoid valve assembly 12 by means of appropriate tubing as shown. Solenoid valve assembly 12 includes three separately activatable solenoid valves: one for the deck lid release actuator, one for the fuel filler door release actuator and one for the door lock actuators. Each has a movable valve member normally biased into a position wherein the pneumatic line to the associated actuator is open to the atmosphere and an activating coil effective to move the movable member into a different position wherein the line to the associated actuator is open to vacuum/pressure pump 11. Thus, whichever valve is activated communicates vacuum/pressure pump 11 with the chosen actuator; and all the other actuators are open to atmospheric pressure so that they are free for manual activation.

Figure 2:
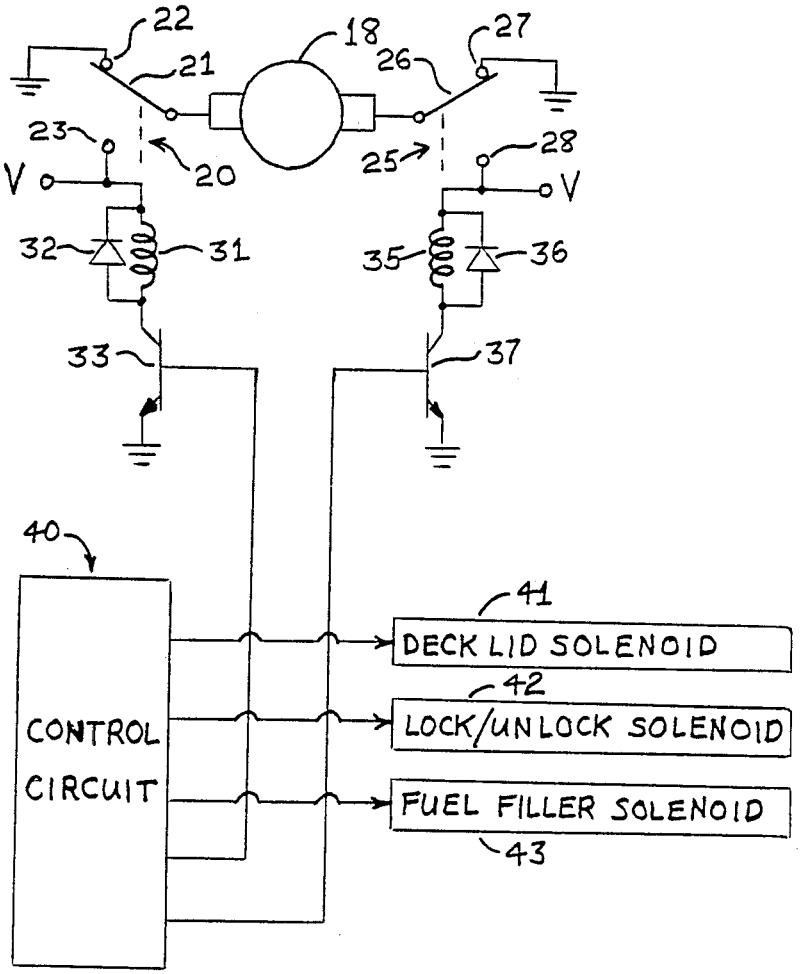
FIG. 2 is a diagram of an electrical control for the electropneumatic actuation system of FIG. 1.

Vacuum/pressure pump 11 works bidirectionally to provide vacuum or positive pressure in the system, but not both at once. It is of standard construction and is driven by a bidirectional DC motor 18, which appears schematically in FIG. 2. The armature terminals of motor 18 are connected to the armatures 21 and 26 of relays 20 and 25, respectively, which have grounded normally closed contacts 22 and 27, respectively. The normally open contacts 23 and 28 of relays 20 and 25, respectively, are connected to DC power source V, which represents the vehicle DC electrical power system at 12–16 volts.

An activating coil 31 of relay 20 is connected from voltage V in parallel with a free-wheeling diode 32 and in series with the collector of an NPN transistor 33 having a grounded emitter. Transistor 33 has a base which, when provided with a high voltage, causes transistor 33 to activate relay 20 to connect the armature of motor 18 across voltage V in a first polarity and thus drive vacuum/pressure pump 11 to provide vacuum to solenoid valve assembly 12. Likewise, an activating coil 35 of relay 25 is connected from voltage V in parallel with a free-wheeling diode 36 and in series with the collector of an NPN transistor 37 having a grounded emitter. Transistor 37 has a base which, when provided with a high voltage, causes transistor 37 to activate relay 25 to connect the armature of motor 18 across voltage V in the opposite polarity to run motor 18 in the reverse direction and thus drive vacuum/pressure pump 12 to provide positive pressure above atmospheric pressure to solenoid valve assembly 12.

The application of vacuum or positive pressure from pump 11 to actuators 13, 15 and 16 is controlled by the valves of solenoid valve assembly 12. A deck lid solenoid 41 is a solenoid valve with normally closed position in which the pneumatic line to deck lid actuator 13 is closed to pump 11 but open to the atmosphere to allow manual activation of the actuator. Likewise, a fuel filler solenoid 43 is a solenoid valve with a closed position in which the pneumatic line to fuel filler door actuator 15 is closed to pump 11 but open to the atmosphere to allow manual activation of the actuator. Either of the deck lid solenoid 41 or fuel filler solenoid 43 may be activated to an open position in which the pneumatic line to the appropriate actuator is open to pump 11 and closed to atmosphere, whereby activation of the actuator occurs. Finally, a lock/unlock solenoid is a solenoid valve with a closed position in which the pneumatic lines to the door lock actuators 16 are closed to pump 11 but open to the atmosphere and may likewise be activated to an open position in which the pneumatic lines leading to door lock actuators are open to pump 11 and closed to the atmosphere. In this embodiment, vacuum and positive pressure, respectively, are communicated to door lock actuators 16 for locking and unlocking as a group. Only vacuum is communicated to deck lid actuator 13 or fuel filler door actuator 15 for release of these doors. However, if desired, these doors could also use either vacuum or positive pressure for locking and unlocking. the solenoids 41, 42 and 43, as well as relays 20 and 25, are controlled by a control circuit 40, which is shown in detail in FIG. 3.

Figure 3:
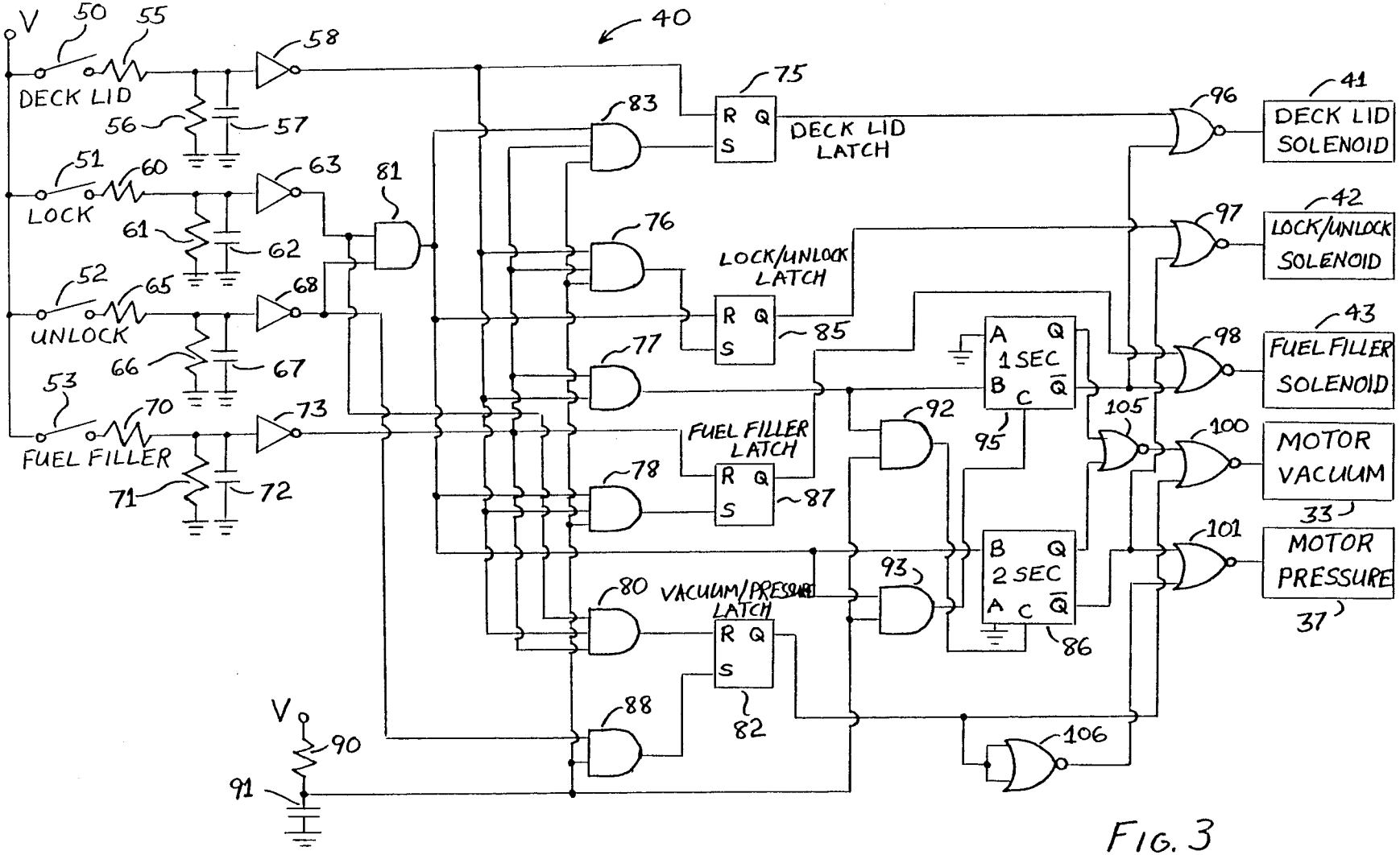
FIG. 3 is a circuit diagram of the control circuit of FIG. 2.

Referring to FIG. 3, switches 50, 51, 52 and 53 are provided for deck lid release, door lock, door unlock and fuel filler door release, respectively. Each of switches 50–53 is connected to voltage V and has a normally open terminal connected through a debounce low pass filter and an inverter. Switch 50, for example, is connected through a series resistor 55 (1K) with a resistor 56 (10K) and capacitor 57 (0.01 mF) connected in parallel to ground and a series Schmitt trigger inverter 58. Similar elements for switches 51, 52 and 53 are numbered, in the same order, 60–63, 65–68 and 70–73, respectively. Thus, inverters 58, 63, 68 and 73 provide low signals upon the closing of switches 50, 51, 52 and 53, respectively.

Inverter 58 provides the deck lid signal to the reset input of a flip-flop 75 (4044 NAND) which serves as a deck lid latch, as well as to inputs of AND gates 76 (4073), 77 (4081), 78 (4073) and 80 (4073). Inverter 63 provides the door lock signal to an input of an AND gate 81 (4081) as well as to another input of AND gate 80, which has an output connected to the reset input of a flip-flop 82 (4044 NAND) serving as a vacuum/pressure latch. Inverter 68 provides the door unlock signal to the other input of AND gate 81 as well as to an input of an AND gate 88 (4081), which has an output connected to the set input of vacuum/pressure latch flip-flop 82. The output of AND gate 81 is connected to an input of an AND gate 83 (4073) having an output to the set input of deck lid latch flip-flop 75 (4044 NAND), to the reset input of a flip-flop 85 (4044 NAND) serving as a lock/unlock latch, to another input of AND gate 78 and to the B (initiating) input of a 2 second timer 86. The output of AND gate 78 is connected to the set input of a flip-flop 87 (4044 NAND) serving as a fuel filler latch; the output of AND gate 76 is connected to the set input of lock/unlock latch flip-flop 85.

Inverter 73 provides the fuel filler signal to other inputs of AND gates 83, 76, 77 and 80, as well as to the reset input of fuel filler latch flip-flop 87. There is an initialization master clear circuit comprising a resistor 90 (30K) and capacitor 91 (330 uF) connected in series across voltage V. The junction of resistor 90 and capacitor 91 is connected to other inputs of AND gates 83, 76, 78 and 88, as well as to inputs of two more AND gates 92 and 93 (4081). The other input of AND gate 92 is connected to the output of AND gate 77; while the other input of AND gate 93 is connected to the output of AND gate 81. The output of AND gate 77 is connected to the B (initiating) input of a 1 second timer 95. The outputs of AND gates 92 and 93 are connected to the C (clear) inputs of timers 96 and 95, respectively.

A NOR gate 96 has inputs from the Q output of deck lid latch flip-flop 75 and the NOT Q output of 1 second timer 95. NOR gate 96 has an output connected to activate deck lid solenoid 41 when a high output voltage is produced. Similarly, a NOR gate 97 has inputs from the Q output of lock/unlock latch flip-flop 85 and the NOT Q output of 2 second timer 86. NOR gate 97 has an output connected to activate lock/unlock solenoid 42 when a high output voltage is produced. Likewise, a NOR gate 98 has inputs from the Q output of fuel filler latch flip-flop 87 and the NOT Q output of 1 second timer 95. NOR gate 98 has an output connected to activate fuel filler solenoid 43 when a high output voltage is produced. Since each of the latch flip-flops 75, 85 and 87 will be reset to a low output when the appropriate switch 50, 51, 52 or 53 is closed, the appropriate NOR gate will activate its controlled solenoid for the time duration of the appropriate timer.

A NOR gate 100 has inputs from the Q output of vacuum/pressure latch flip-flop 82 and from the output of a NOR gate 105 which itself has inputs from the Q outputs of timers 86 and 95. The output of NOR gate 100 is connected to activate the transistor 33 in FIG. 2, which causes motor 18 to produce vacuum from pump 11 and is thus labeled "motor vacuum" in FIG. 3. A NOR gate 101 has inputs from the NOT Q output of 2 second timer 86 and from the Q output of vacuum/pressure latch flip-flop 82 through an inverter 106. The output of NOR gate 101 is connected to activate transistor 37 of FIG. 2, which causes motor 18 to produce positive pressure above atmospheric pressure from pump 11 and is thus labeled "motor pressure" in FIG. 3. NOR gates 100 and 101 are controlled in response to the activation of switches 50–53 to produce vacuum or positive pressure as appropriate for the chosen lock or unlock function.

In operation, the system begins with the application of voltage V. The outputs of inverters 58, 63, 68 and 73 are high; the initial voltage on capacitor 91 is low. AND gates 83, 76, 78 and 88 are sent low temporarily by capacitor 91. The latch flip-flops 75, 85, 87 and 82 are of the type which are set or reset by an input going low. Thus, they are all set to a high Q output by the initialization circuit. High signals are also applied to the B and C inputs of timers 86 and 95. Thus no actuators or relays are activated.

Activation of the deck lid switch 50 causes a reset of deck lid latch flip-flop 75 and a low transition to the B input of 1 second timer 95. Timers 95 and 86 are initiated by a low transition on the B input. Therefore timer 95 (NOT Q output) and latch 75 (Q output) provide low signals to NOR gate 96 to activate deck lid solenoid 41. A high Q output from timer 95 sends the output of NOR gate 105 low; and vacuum/pressure latch flip-flop 82 is reset to provide a low output. Thus, NOR gate 100 sees both inputs low and activates relay 33 to provide motor vacuum through the open deck lid solenoid 41 to deck lid actuator 13. The other NOR gates 97, 98 and 101 all see at least one high input; and thus no other solenoids or relays are activated.

Activation of the fuel filler door switch 53 produces similar action except that the fuel filler latch flip-flop 87, NOR gate 98 and fuel filler solenoid 43 replace the equivalent deck lid components in the circuit for activation; and vacuum is thus sent through the open fuel filler solenoid to fuel filler door actuator 15.

Passenger door locking is initiated with lock switch 51. Lock/unlock latch flip-flop 85 is reset and 2 second timer 86 initiated to provide low inputs to NOR gate 97 and activate lock/unlock solenoid 42. Vacuum/pressure latch flip-flop 82 is reset to provide one low input to NOR gate 100; and a high Q output from 2 second timer 86 provides the other low input to cause NOR gate 100 to activate transistor 33 for motor vacuum.

Passenger door unlocking is initiated with unlock switch 52. Lock/unlock latch flip-flop 85 is reset and 2 second timer 86 initiated to provide low inputs to NOR gate 97 and activate lock/unlock solenoid 42. Vacuum/pressure latch flip-flop 82 is set to provide one low input by means of NOR gate 106 to NOR gate 101; and a high Q output from 2 second timer 86 provides the other low input to cause NOR gate 101 to activate transistor 37 for motor pressure.

It should be noted that the latch which is reset in one operation is left reset after the timer times out to stop the activation of the pneumatic system. Thus, if a different operation is chosen next, the logic, through the appropriate AND gates, sets the last latches not chosen for the new operation as it resets the latches chosen. In fact, if a new operation is begun before an old operation is finished, the same thing will happen: the logic will automatically terminate the activations of the old operation not appropriate to the new. In addition, through one of AND gates 92 and 93, it will terminate the timer and initiate the new timer, even if the same timer is used.

Thus, the system provides for passenger door locking using vacuum, passenger door unlocking using positive pressure, and auxiliary door unlocking using vacuum, where the auxiliary door may be a deck lid or fuel filler door. It coordinates the production of vacuum or pressure and the communication of this to the appropriate actuator or actuators. The locking or unlocking functions are independent of each other for maximum flexibility.

The embodiments of the invention in which an exclusive property or privilege is claimed are defined as follows:

1. A power door lock control for a motor vehicle comprising, in combination:

a pump activatable to generate a first pressure or a second pressure but not both simultaneously, one of the first and second pressures being above atmospheric pressure and the other being below atmospheric pressure;

a passenger door lock actuator responsive to the first pressure to perform a first locking operation and further responsive to the second pressure to perform a second locking operation;

an auxiliary door lock actuator responsive to one of the first and second pressures to perform a third locking operation;

a passenger solenoid valve activatable to communicate the pump with the passenger door lock actuator;

an auxiliary solenoid valve activatable to communicate the pump with the auxiliary door lock actuator;

a bistable pressure latch;

a bistable passenger lock latch;

a bistable auxiliary lock latch;

a first timer having, when started, a first time period of activation with self termination at the end thereof;

a second timer having, when started, a second time period of activation different from the first time period of activation with self termination at the end thereof;

passenger lock initiation means;

passenger unlock initiation means;

auxiliary initiation means;

first circuit means repsonsive to activation of the auxiliary initiation means to set the auxiliary latch in a first state, set the passenger lock latch in a second state, start the first timer and terminate the second timer;

second circuit means responsive to activation of the passenger lock initiation means or passenger unlock initiation means to set the passenger lock latch in a first state, set the auxiliary latch in a second state, start the second timer and terminate the first timer;

third circuit means responsive to activation of one of the passenger lock initiation means and passenger unlock initiation means to set the pressure latch in a first state;

fourth circuit means responsive to activation of the other of the the passenger lock initiation means and passenger unlock initiation means to set the pressure latch in a second state;

fifth circuit means responsive to activation of the auxiliary initiation means to set the pressure latch in one of its first and second states;

sixth circuit means responsive to the first state of the auxiliary lock latch with activation of the first timer to activate the auxiliary solenoid valve;

seventh circuit means responsive to the first state of the passenger lock latch with activation of the second timer to activate the passenger solenoid valve;

eighth circuit means responsive to the first state of the pressure latch with activation of the second timer to activate the pump to generate the first pressure;

ninth circuit means responsive to the second state of the pressure latch with activation of the second timer to activate the pump to generate the second pressure; and tenth circuit means responsive to the one of the first and second states of the pressure latch with activation of the first timer to activate the pump to generate the one of the first and second pressures.

2. The electropneumatic power door lock control of claim 1 in which the first and second locking operations are locking and unlocking of a vehicle passenger door, the auxiliary door lock actuator is a release mechanism for a vehicle trunk lid or fuel filler door and the third locking operation is the release thereof, the first timer has a time period significantly shorter than that of the second timer and one of the first and second pressures is greater than and the other less than atmospheric pressure.

* * * * *